US009837702B2

(12) United States Patent
Sharawi et al.

(10) Patent No.: US 9,837,702 B2
(45) Date of Patent: Dec. 5, 2017

(54) COGNITIVE RADIO ANTENNA ASSEMBLY

(71) Applicant: KING FAHD UNIVERSITY OF PETROLEUM AND MINERALS, Dhahran (SA)

(72) Inventors: Mohammad S. Sharawi, Dhahran (SA); Rifaqat Hussain, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 97 days.

(21) Appl. No.: 14/641,253

(22) Filed: Mar. 6, 2015

(65) Prior Publication Data

US 2016/0261050 A1 Sep. 8, 2016

(51) Int. Cl.

| | |
|---|---|
| ***H01Q 21/30*** | (2006.01) |
| ***H01Q 1/24*** | (2006.01) |
| ***H01Q 1/38*** | (2006.01) |
| ***H01Q 9/42*** | (2006.01) |
| ***H01Q 21/28*** | (2006.01) |
| ***H01Q 5/321*** | (2015.01) |

(52) U.S. Cl.
CPC ..... *H01Q 1/243* (2013.01); *H01Q 1/38* (2013.01); *H01Q 5/321* (2015.01); *H01Q 9/42* (2013.01); *H01Q 21/28* (2013.01)

(58) Field of Classification Search
CPC ..... H01Q 21/30; H01Q 1/241–1/243
See application file for complete search history.

(56) References Cited

U.S. PATENT DOCUMENTS

| | | | | |
|---|---|---|---|---|
| 7,002,470 | B1 | 2/2006 | Miao | |
| 7,079,079 | B2 * | 7/2006 | Jo | H01Q 1/243 343/700 MS |
| 7,411,554 | B2 | 8/2008 | Jung et al. | |
| 7,830,309 | B2 | 11/2010 | Ward et al. | |

(Continued)

OTHER PUBLICATIONS

Jong-Hyuk Lim et al., "Simultaneous Frequency and Isolation Reconfigurable MIMO PIFA Using PIN Diodes", IEEE Transactions on Antennas and Propagation (Dec. 2012), vol. 60, No. 12, pp. 5939-5946 (Abstract only).

(Continued)

*Primary Examiner* — Dameon E Levi
*Assistant Examiner* — Hasan Islam
(74) *Attorney, Agent, or Firm* — Oblon, McClelland, Maier & Neustadt, L.L.P.

(57) ABSTRACT

The cognitive radio antenna assembly includes two boards, a main board that has an ultra-wideband antenna (UWB) and also serves as a ground plane for the reconfigurable antenna, and an elevated MIMO board having two planar inverted-F antennas (PIFAs) that are reconfigurable to selectively operate on different frequency bands. Each PIFA has a radiating patch having a slot bridged by PIN diodes and DC blocking capacitors on opposite sides of the slot. The resonant frequency of each PIFA is controlled by which diodes are switched on and off. The PIFA antennas are shorted to the ground plane the (UWB antenna) on the main board by shorting walls. The PIFA antennas are capable of resonating from the 700 MHz band through 3000 MHz, while the UWB senses the spectrum over the entire bandwidth. The antenna assembly is compact, being suitable for cellular phone and wireless applications in 4G wireless standards.

2 Claims, 11 Drawing Sheets

(56) References Cited

U.S. PATENT DOCUMENTS

| | | | | |
|---|---|---|---|---|
| 8,754,817 | B1 * | 6/2014 | Kuo | H01Q 1/243 343/700 MS |
| 2005/0140554 | A1 * | 6/2005 | Wang | H01Q 1/243 343/702 |
| 2013/0273858 | A1 | 10/2013 | Sover et al. | |
| 2014/0132478 | A1 * | 5/2014 | Wang | H01Q 1/243 343/893 |
| 2014/0240189 | A1 * | 8/2014 | Rowel | H01Q 5/40 343/810 |

OTHER PUBLICATIONS

R. Hussain et al., "A Compact Reconfigurable Multi-band MIMO Antenna System", IEEE (2014, pp. 480-181.

Hussain and Sharawi, "A Cognitive Radio Reconfigurable MIMO and Sensing Antenna System," Antennas and Wireless Propagation Letters, vol. PP, Issue: 99, Oct. 2, 2014.

* cited by examiner

COGNITIVE RADIO ANTENNA ASSEMBLY

BACKGROUND OF THE INVENTION

1. Field of the Invention

The present invention relates to communication systems, and particularly to a cognitive radio antenna assembly that includes an ultra-wide band sensing antenna and reconfigurable multiple-input multiple-output (MIMO) antennas and is operable in multiple bands between 700 MHz and 3 GHz.

2. Description of the Related Art

In modern wireless communications, the exponential growth of wireless services results in an increasing demand of the data rate requirements and reliability of data. These services can include high quality audio/video calls, online video streaming, video conferencing and online gaming, for example. These services can require wide bandwidth operation or covering operation across several frequency bands. This resulted in efforts to make efficient utilization of the available spectrum via sensing the available unused or underutilized bands.

Overcoming the inefficient and highly underutilized spectrum resources has led to the concept of cognitive radio (CR). CR systems are based on the structural design of software-defined radio (SDR) intended to enhance the spectrum utilization efficiency by interacting with the operating environment. A CR-based system should be aware of its environment by sensing the spectrum usage, and should also have the capability to switch over the operating points among different unoccupied frequency bands. CR-based systems may cover various features, including sensing spectrum of nearby devices switching between different frequency bands, and power level adjustment of transmitting antennas.

The front end of a CR can include two antennas, one being an ultra-wide band (UWB) sensing antenna and the other being a reconfigurable communication antenna. The UWB antenna can be used to sense the entire spectrum of interest, while the reconfigurable antenna can be used to dynamically change the basic radiating characteristic of the antenna system to utilize the available bandwidth.

Reconfigurable antennas are able to change their operating fundamental characteristics, i.e., resonance frequency, radiation pattern, polarization, and impedance bandwidth. A frequency reconfigurable antenna is a component of CR platforms. A feature of such an antenna is its switching across several frequency bands by activating different radiating parts of the same antenna. CR-based systems are capable of switching the frequency bands of single frequency reconfigurable antennas over different bands to efficiently and inclusively utilize the idle spectrum.

The high date rate requirement due to continuous escalation in wireless handheld device services can be accomplished by employing reconfigurable MIMO antenna systems. MIMO antenna systems are adopted to increase the wireless channel capacity and reliability of data requirements. A key feature of a MIMO antenna system is its ability to multiply data throughput with enhanced data reliability using the available bandwidth, which results in improved spectral efficiency.

To achieve the desired characteristics of reconfigurability and desired performance of MIMO antenna systems, several challenges need to be overcome to accomplish these tasks. These issues include the size of the antennas for low frequency bands, high isolation that is needed between closely spaced antennas, and control circuitry that is needed to be embedded within the given antenna size to achieve the desired reconfiguration. Moreover, the performance of the MIMO system degrades significantly for closely spaced antennas due to high mutual coupling. Additionally, a CR system requires an UWB sensing antenna to scan the wide frequency band. The design of the sensing antenna with the strict dimensions of a mobile terminal size can be a challenging job, as the sensing antenna is required to cover lower frequency bands as well.

Thus, a cognitive radio antenna assembly solving the aforementioned problems is desired.

SUMMARY OF THE INVENTION

The cognitive radio antenna assembly includes two boards, a main board that has an ultra-wideband antenna (UWB) and also serves as a ground plane for the reconfigurable antenna, and an elevated MIMO board having two planar inverted-F antennas (PIFAs) that are reconfigurable to selectively operate on different frequency bands. Each PIFA has a radiating patch having a slot bridged by PIN diodes and DC blocking capacitors on opposite sides of the slot. The resonant frequency of each PIFA is controlled by which diodes are switched on and off. The PIFA antennas are shorted to the ground plane (the UWB antenna) on the main board by shorting walls. The PIFA antennas are capable of resonating from the 700 MHz band through 3000 MHz, while the UWB senses the spectrum over the entire bandwidth. The antenna assembly is compact, being suitable for cellular phone and wireless applications in 4G networks.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
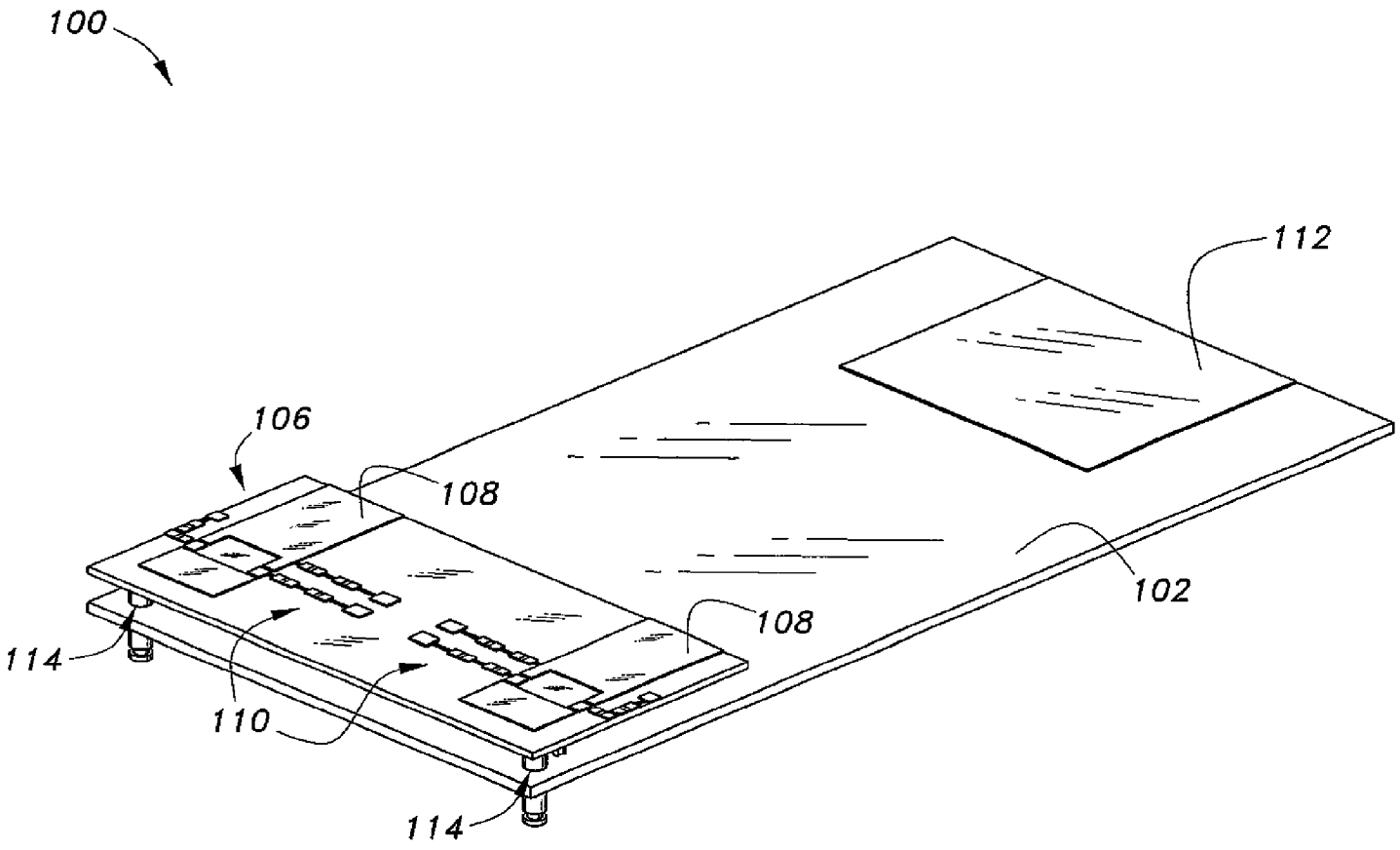
FIG. 1 is a perspective view of cognitive radio antenna assembly according to the present invention.

The cognitive radio antenna assembly includes two boards, a main board that has an ultra-wideband antenna (UWB) and also serves as a ground plane for the reconfigurable antenna, and an elevated MIMO board having two planar inverted-F antennas (PIFAs) that are reconfigurable to selectively operate on different frequency bands. Each PIFA has a radiating patch having a slot bridged by PIN diodes and DC blocking capacitors on opposite sides of the slot. The resonant frequency of each PIFA is controlled by which diodes are switched on and off. The PIFA antennas are shorted to the ground plane (the UWB antenna) on the main board by shorting walls. The PIFA antennas are capable of resonating from the 700 MHz band through 3000 MHz, while the UWB senses the spectrum over the entire bandwidth. The antenna assembly is compact, being suitable for cellular phone and wireless applications in 4G networks.

Referring to FIGS. 1-5B, the cognitive radio antenna assembly 100 has a main board 102 and an upper or elevated MIMO board 106 raised above the main board 102 by spacers or standoffs. Each board 102, 106 is made from a flat sheet or panel of dielectric material that is clad with copper on both sides. The copper is etched or removed from the opposing faces of the boards 102, 106 to form the patterns shown in the drawings. The boards 102, 106 may be made from printed circuit boards. For example, the main board 102 may be made from printed circuit board having a dielectric constant $\in_r$=4.4 and a thickness of 1.56 mm, and the upper or MIMO board 106 may be made from an FR-4 printed circuit board having a dielectric constant $\in_r$=4.4 and a thickness of 0.8 mm. The height of the two-board assembly is about 5.8 mm.

Figure 2:
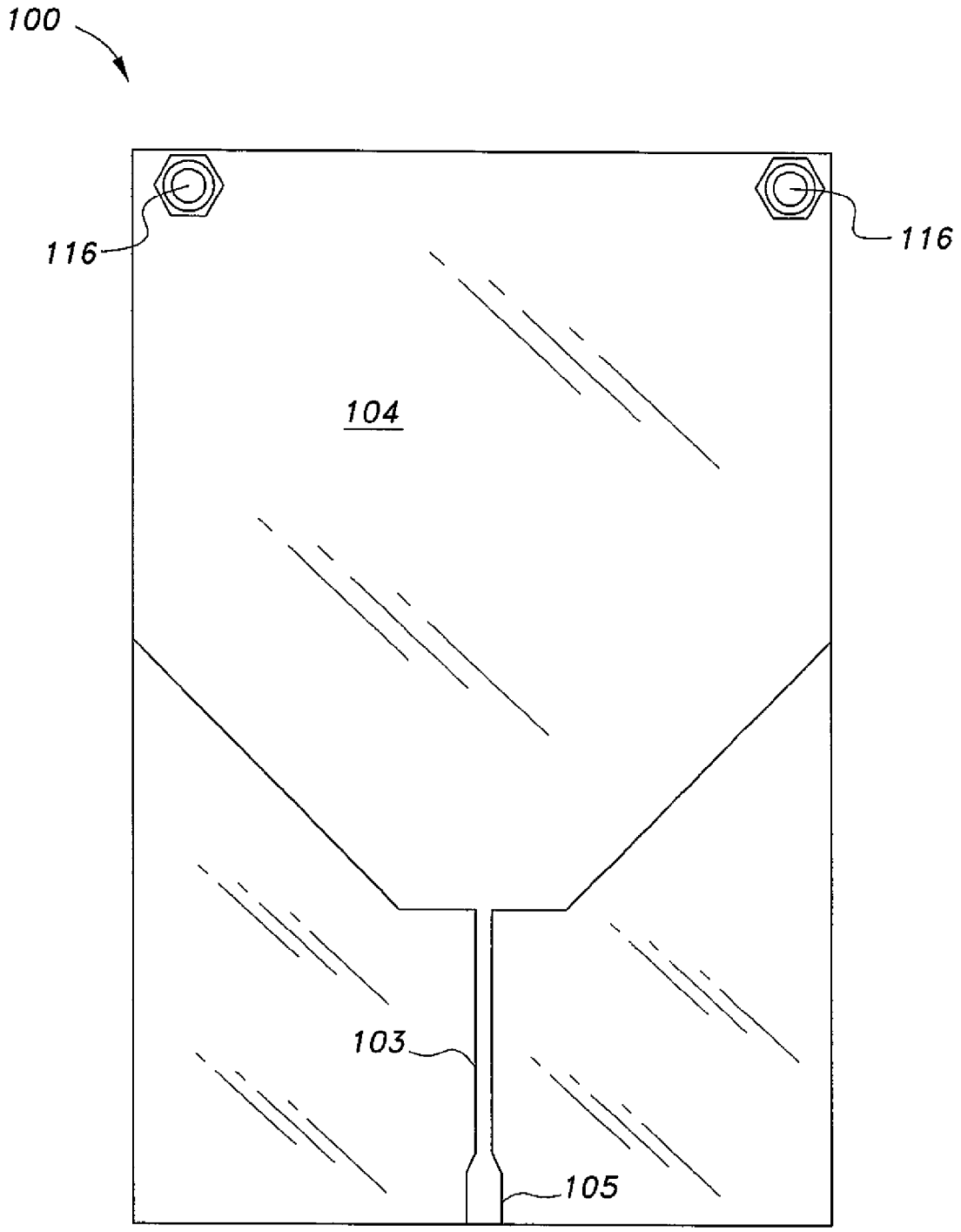
FIG. 2 is a bottom view of the main board of the cognitive radio antenna assembly of FIG. 1.

The main board 102 may have dimensions of 65 mm×120 mm. The ultra-wideband antenna is a monopole antenna formed on the main board 102. The sensing element 104 of the ultra-wideband antenna is formed on the bottom face of the main board 102, as shown in FIG. 2. The sensing element 104 has a rectangular base measuring about 65 mm×54.72 mm and a trapezoidal portion extending from the base. The trapezoidal portion has a base leg of 65 mm, a parallel upper leg of 16 mm, and opposing diagonal legs of 39 mm. A 1.5 mm wide transmission line 103 extends from the upper leg of the trapezoidal portion to the edge of the main board 102 (a length of about 34.8 mm), terminating in a 3 mm wide terminal pad 105. The center line of the transmission line 103 bisects the width of the main board 102 (about 32.5 mm from the longitudinal edge of the main board 102. Two SMA connectors 116 are mounted on the upper two corners of the UWB sensing antenna 104. As shown in FIG. 1, a rectangular ground plane 112 measuring 25 mm×40 mm is formed on the top face of the main board 102. The ultra-wideband antenna is capable of sensing or receiving the entire spectrum from about 700 MHz to about 3 GHz. The sensing element 104 of the ultra-wideband antenna also serves as a ground plane or ground reference for the reconfigurable MIMO antenna on the upper or MIMO board 106.

Figure 3:
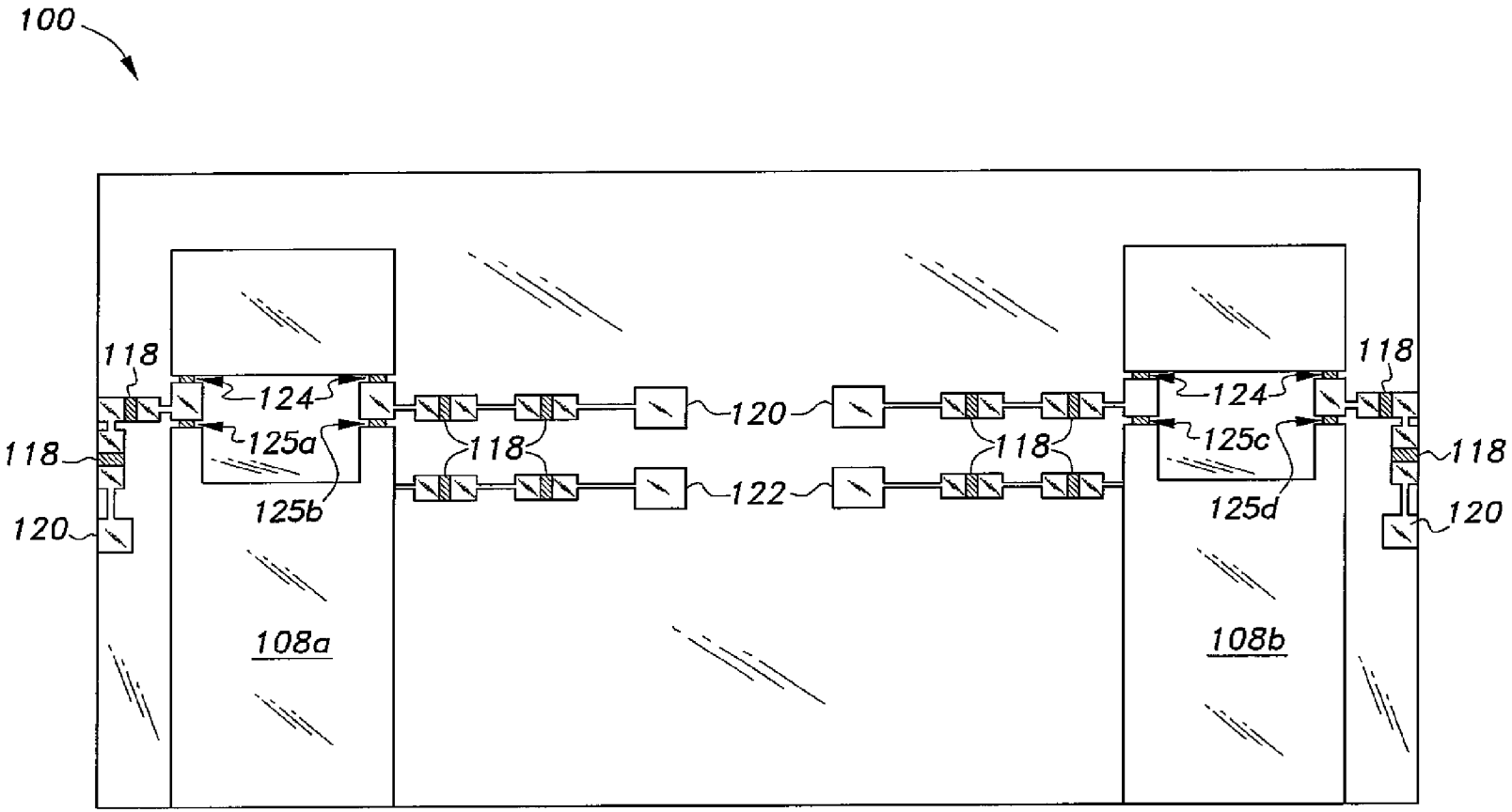
FIG. 3 is a top view of the upper or MIMO board of the cognitive radio antenna assembly of FIG. 1.

The upper or MIMO board 106 has two planar inverted-F antennas (PIFA) 108 formed thereon that are reconfigurable MIMO antennas. FIG. 3 shows a top view of the upper or MIMO board 106 containing the two MIMO reconfigurable antennas, designated as left antenna 108*a* and right antenna 108*b* for clarity in Table 1, below. The upper or MIMO board 106 has dimensions of about 65 mm×30 mm. Each PIFA antenna 108*a*, 108*b* has a radiating patch having a slot bridged by PIN diodes 125*a*, 125*b*, 125*c*, and 125*d*, respectively, and DC blocking capacitors 124 on opposite sides of the slot Each patch has dimensions of about 28 mm×16 mm. Each slot is about 12 mm×6.3 mm. Each side of the slot has a 1.9 mm pad connected to the upper portion of the patch by a blocking capacitor 124 and connected to the lower portion of the patch by a PIN diode 125*a*-125*d*. The PIN diodes have biasing circuitry 110 that includes a 1 μH RF choke in series with a 2.1 kΩ resistor, the passive components being designated 118 in the drawing. A voltage $V_{cc}$ is applied at pads 120, while a digital reference pad is shown at 122. The two MIMO reconfigurable antennas 108 are similar in structure.

Figure 4:
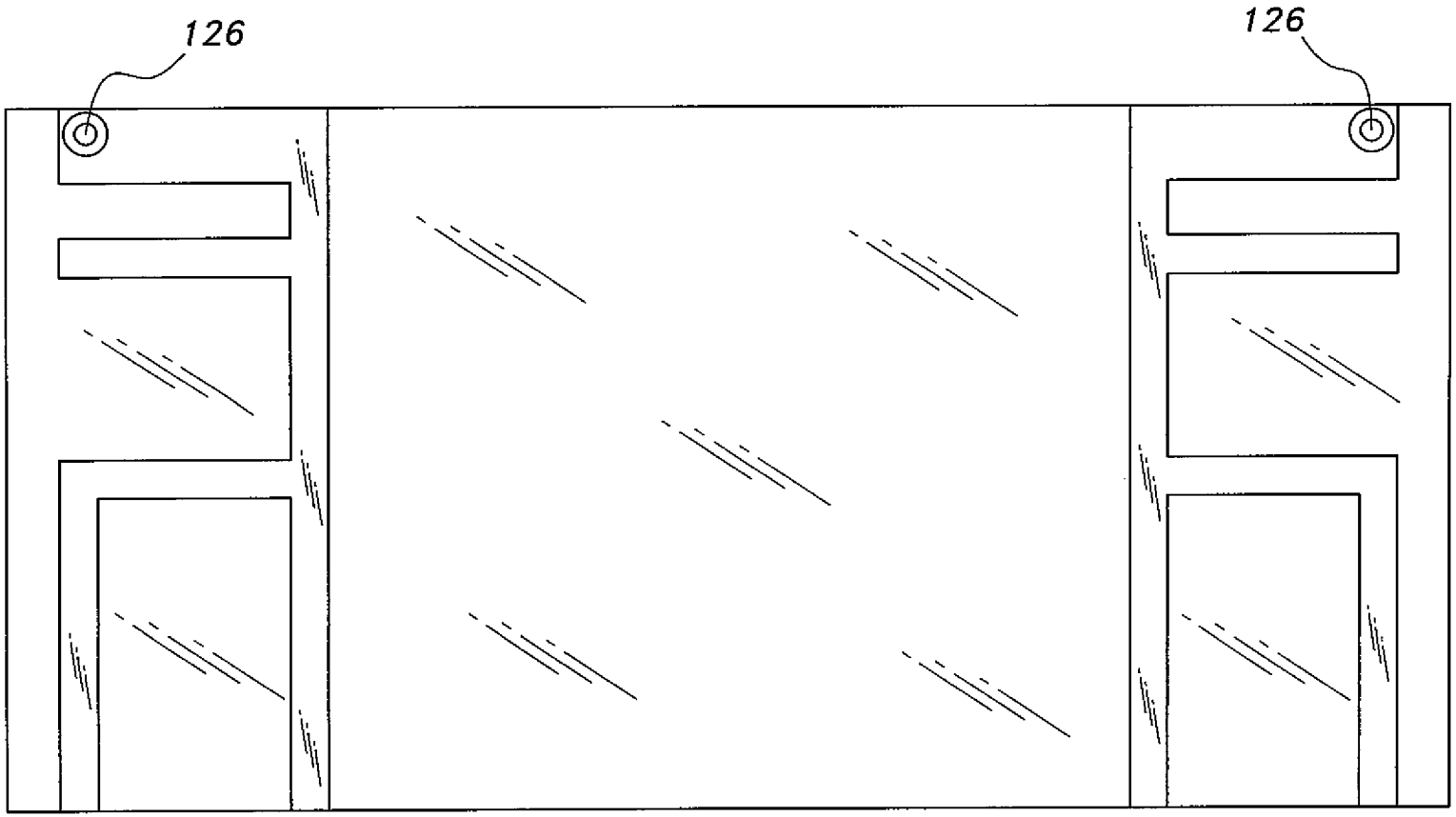
FIG. 4 is a bottom view of the upper or MIMO board of the cognitive radio antenna assembly of FIG. 1.

FIG. 4 shows the bottom face of the upper or MIMO board 106. The bottom face of the MIMO board 106 includes radiating lines and coax feed-lines, and two feed points 126 for the two elements. The dimensions of the different radiating parts of the bottom layer of the PIFA are 12 mm, 3.4 mm, 1.7 mm, 16 mm, 1.7 mm, 8.6 mm, and 30 mm.

Figure 5A:
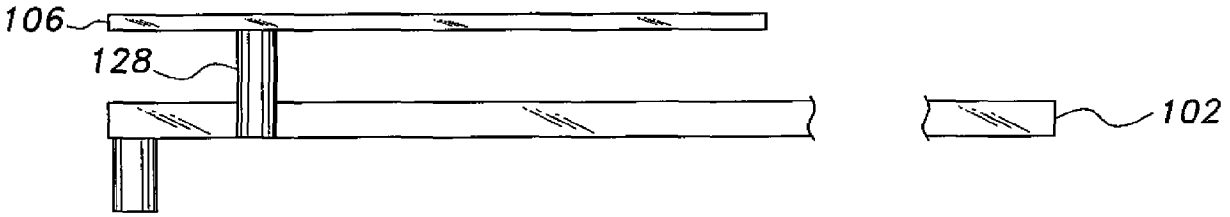
FIG. 5A is a side view of the cognitive radio antenna assembly of FIG. 1.
Figure 5B:
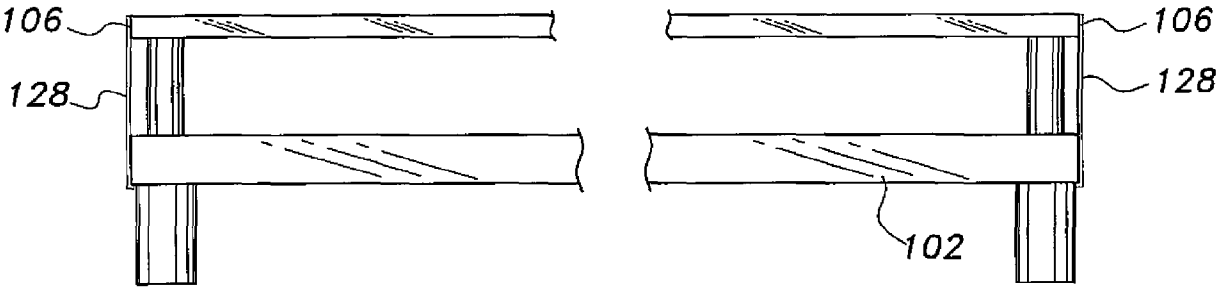
FIG. 5B is a front view of the cognitive radio antenna assembly of FIG. 1.

FIG. 5A is a side view of the elevated PIFA, while FIG. 5B shows a front view of the MIMO reconfigurable antenna 108. Both PIFAs are connected to the sensing element 104 of the UWB antenna through shorting walls 128 of width 1.7 mm extending between the edges of the upper or MIMO board 106 and the main board 102.

Figure 6:
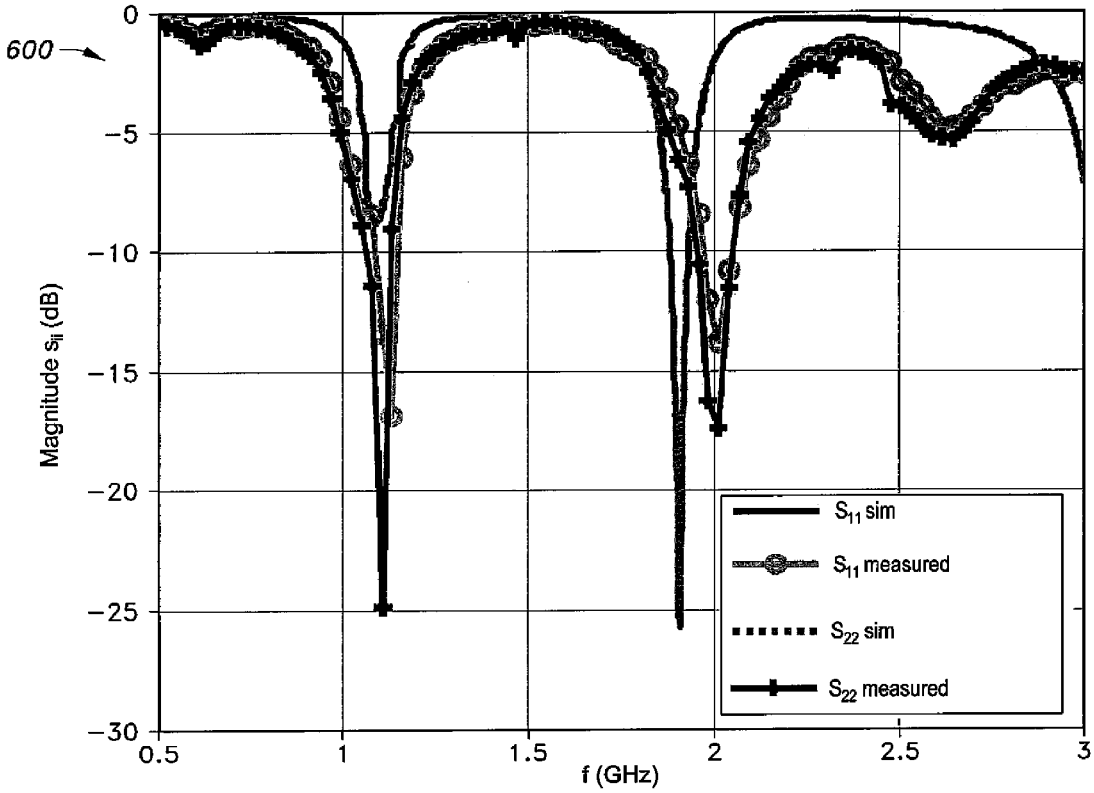
FIG. 6 is a plot showing the reflection coefficient curves of the cognitive radio antenna assembly of FIG. 1 operating in Mode 1.
Figure 7:
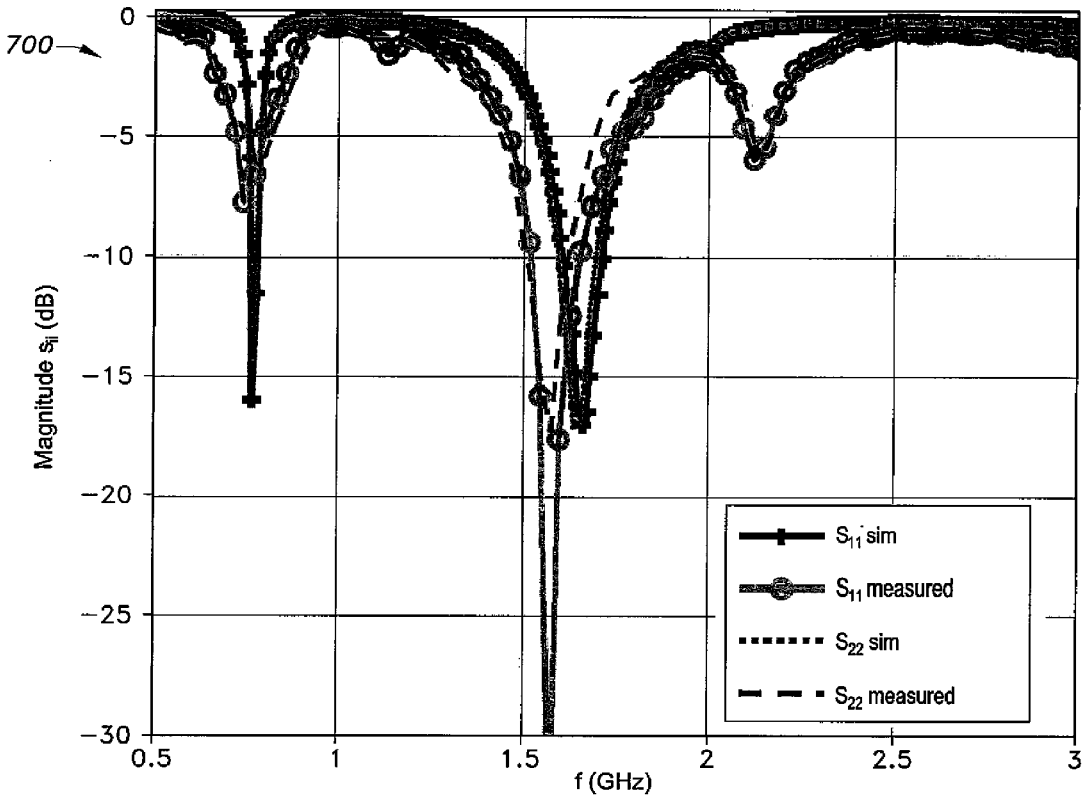
FIG. 7 is a plot showing the reflection coefficient curves of the cognitive radio antenna assembly of FIG. 1 operating in Mode 2.
Figure 8:
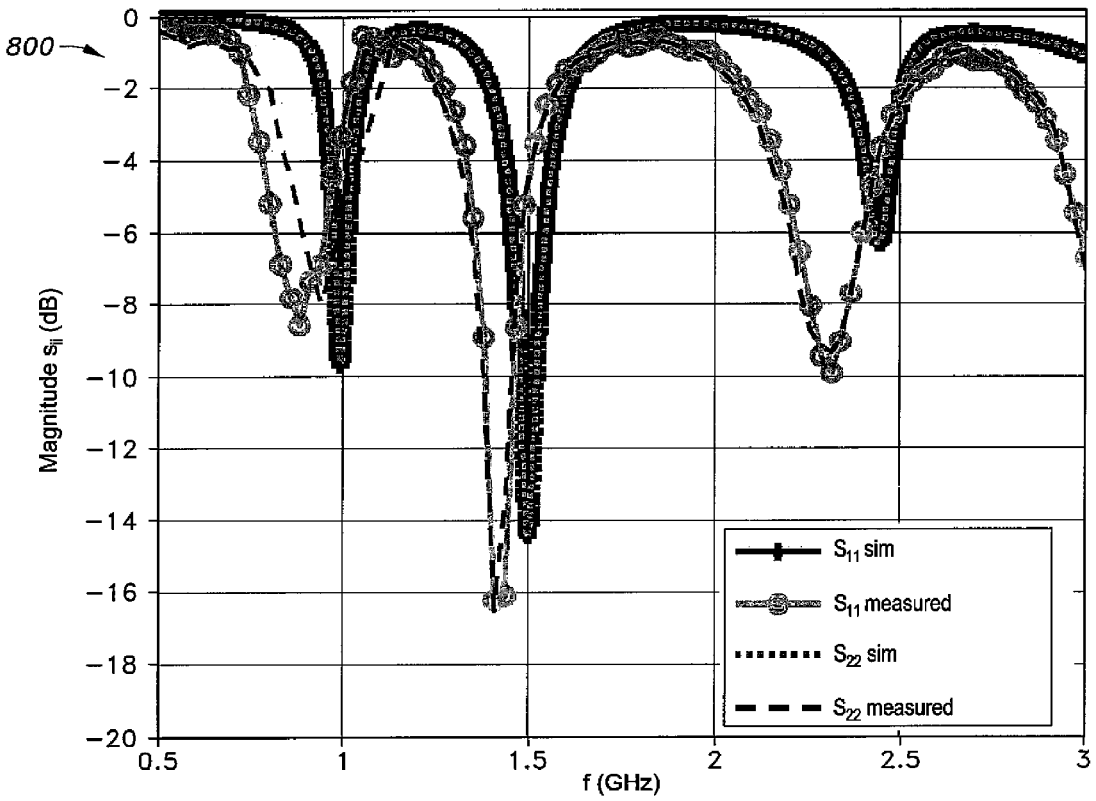
FIG. 8 is a plot showing the reflection coefficient curves of the cognitive radio antenna assembly of FIG. 1 operating in Mode 3.
Figure 9:
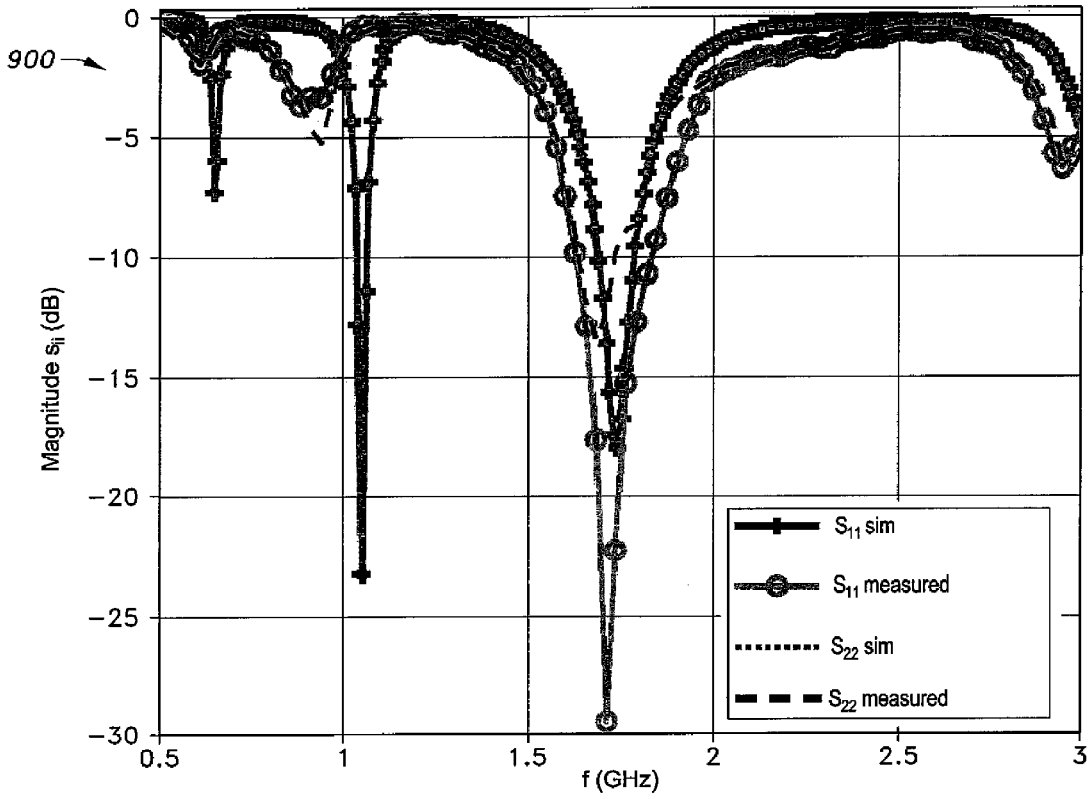
FIG. 9 is a plot showing the reflection coefficient curves of the cognitive radio antenna assembly of FIG. 1 operating in Mode 4.
Figure 10:
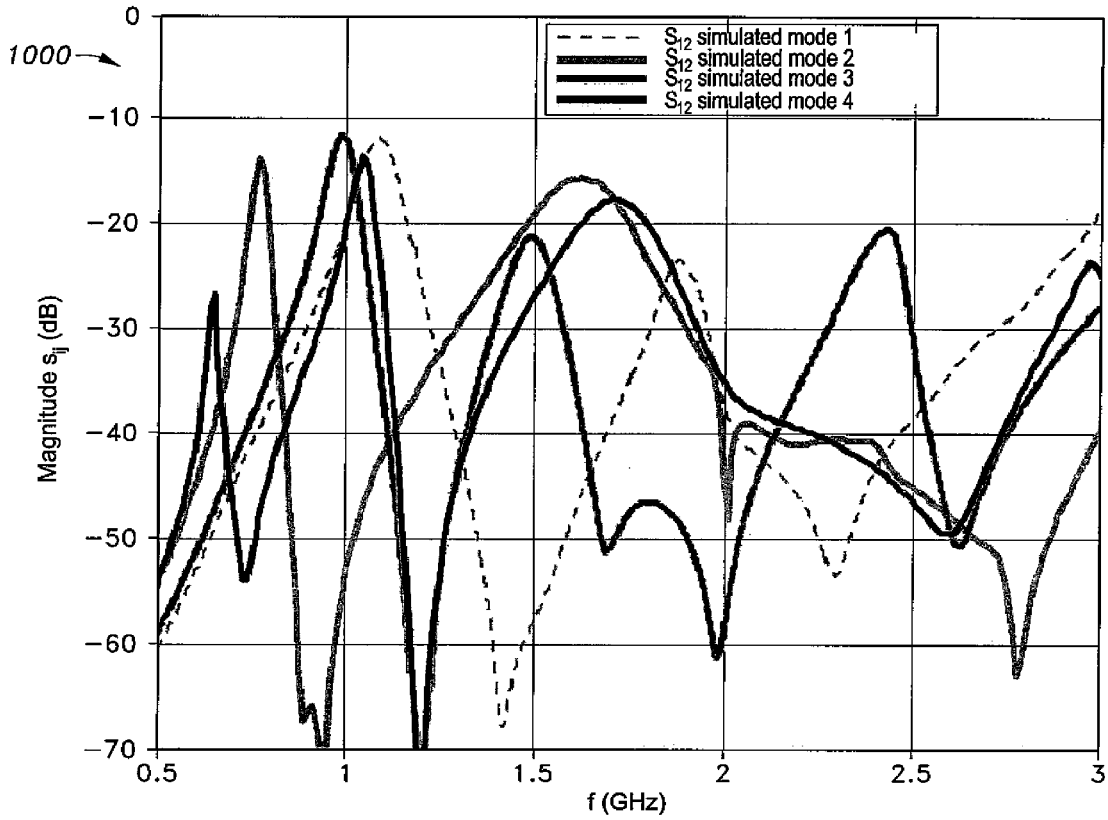
FIG. 10 is a plot showing the simulated mutual coupling curves of the reconfigurable MIMO antennas of the cognitive radio antenna assembly of FIG. 1.
Figure 11:
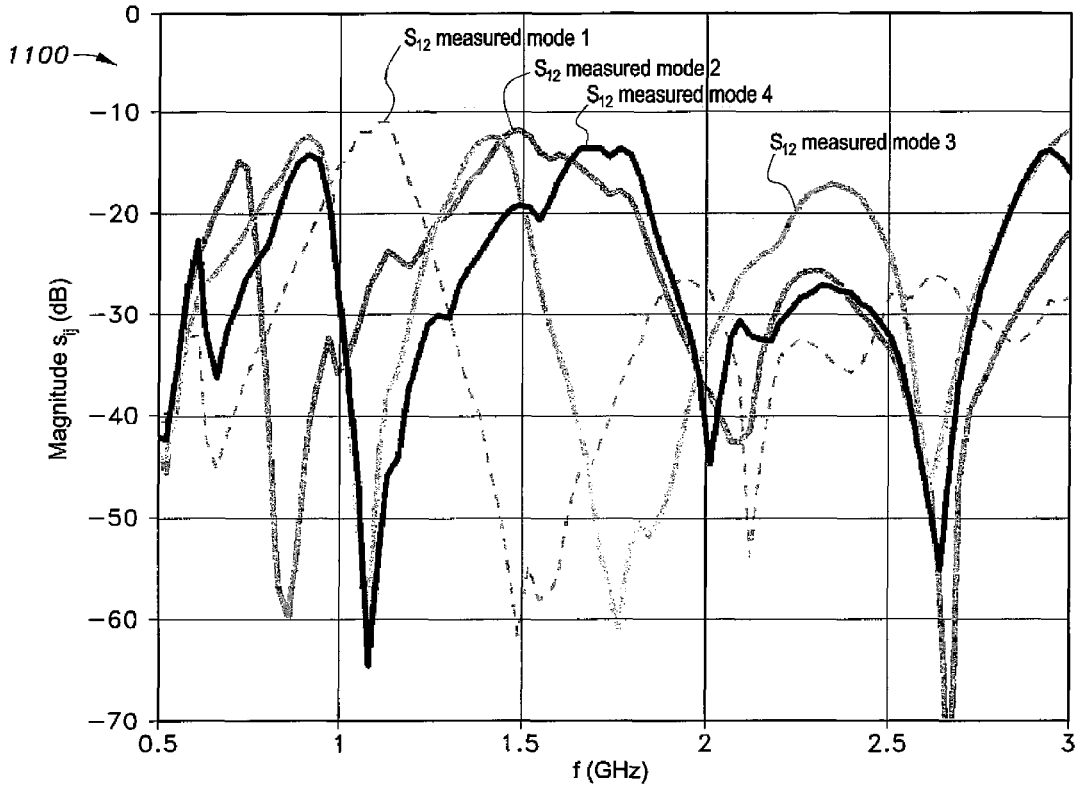
FIG. 11 is a plot showing the measured mutual coupling curves of the reconfigurable MIMO antennas of the cognitive radio antenna assembly of FIG. 1.

Referring to FIGS. 6-9, the compact reconfigurable MIMO antennas system 100 can operate in four different modes depending on the state of the four PIN diodes 125*a*-125*b*. The details of all modes are given in Table 1. The PIN diodes 125*a*-125*d* short the upper and lower portions of the PIFA patch antennas when they are turned ON (they are conducting), and leave the upper and lower portions open when they are OFF (they are not conducting) by adjusting the respective bias currents to the diodes 125*a*-125*d*, thereby altering the electrical length of the PIFA patch antennas and their corresponding resonant frequencies. In mode 1, the two resonating frequencies are 1093 MHz and 1900 MHz. The reflection coefficient curves 600 are shown in FIG. 6 for both simulated and fabricated models. In mode 2, both antennas were resonating at 770 MHz and 1640 MHz. The reflection coefficient curves 700 are shown in FIG. 7. Similarly, in mode 3, the resonating frequencies are 994 MHz and 1500 MHz, while in mode 4, the single resonating frequency achieved was 1740 MHz. The reflection coefficient curves 800 for mode 3 are shown in FIG. 8 and the reflection coefficient curves 900 of mode 4 are shown in FIG. 9. The simulated coupling curves 1000 are shown in FIG. 10 and the measured mutual coupling curves 1100 are shown in FIG. 11. Table 1 shows the switching state of the four PIN diodes 125*a*-125*d* in Modes 1 through 4. Table 2 shows the resulting resonant frequencies in the four modes.

TABLE 1

Diode Switching States in Mode 1 Through Mode 4

| S. No. | Diode 1-LA-LD 125a | Diode 2-LA-RD 125b | Diode 3-RA-LD 125c | Diode 4-RA-RD 125d |
|---|---|---|---|---|
| Mode-1 | OFF | OFF | OFF | OFF |
| Mode-2 | ON | OFF | OFF | ON |
| Mode-3 | OFF | ON | ON | OFF |
| Mode-4 | ON | ON | ON | ON |

TABLE 1-continued

| Diode Switching States in Mode 1 Through Mode 4 | | | | |
|---|---|---|---|---|
| S. No. | Diode 1-LA-LD 125a | Diode 2-LA-RD 125b | Diode 3-RA-LD 125c | Diode 4-RA-RD 125d |

LA = Left Antenna (108a)
RA = Right Antenna (108b)
LD = Left Diode 125a or 125c
RD = Right Diode 125b or 125d

TABLE 2

| Resonant Frequencies of PIFA Antennas | | |
|---|---|---|
| S. No. | Band 1 | Band 2 |
| Mode-1 | 1093 | 1900 |
| Mode-2 | 770 | 1640 |
| Mode-3 | 994 | 1500 |
| Mode-4 | 1740 | — |

It will be seen that the antenna assembly 10 has a compact form factor, measuring 65×120 $mm^2$ and 5.8 mm high, rendering the assembly suitable for smart phones and LTE mobile handsets, as well as other compact wireless devices. The frequency range of the antenna assembly 10, including an ultra-wideband antenna for sensing the spectrum for available frequencies and reconfigurable multiband MIMO transmit and receive antennas to support communications on any available frequency, makes it suitable for a cognitive radio platform for 4G devices. The planar structure of the antennas and operating characteristics of the antennas and control circuitry are easily integrated with other microwave or digital ICs and other low profile microwave components so that the assembly 10 can be easily accommodated within wireless handheld devices in wireless bands between 700 MHz and 3 GHz. Research for the above was funded by the National Plan for Science, Technology and Innovation (MAARIFAH), located in King Abdulaziz City for Science and Technology, Kingdom of Saudi Arabia, award number 12-ELE3001-04.

It is to be understood that the present invention is not limited to the embodiments described above, but encompasses any and all embodiments within the scope of the following claims.

We claim:

1. A cognitive radio antenna assembly, comprising:

a rectangular main board having a top face and a bottom face, the bottom face having a planar sensing element disposed thereon for sensing a 700 MHz to 3 GHz ultra-wideband spectrum, the sensing element including a transmission line extending from one end of the sensing element and bisecting the width of the main board, the transmission line terminates in a terminal pad, the top face having a planar rectangular ground plane for the planar sensing element, whereby the sensing element and the ground plane form an ultra-wideband sensing monopole antenna;

an upper multiple-input, multiple-output (MIMO) board disposed above the main board, the MIMO board having a pair of reconfigurable multiband planar inverted-F antennas (PIFAs) disposed thereon for operation in frequency bands of 700 MHz to 3 GHz, wherein each of the reconfigurable multiband PIFA antennas are elevated patch antennas having a slot defined therein, the slot having slits on opposing sides, each of the elevated patch antennas having an upper portion above the slot, a lower portion below the slot, and PIN diodes connected between the upper portion and the lower portion on opposite sides of the slot, the PIN diodes selectively shorting the upper and lower portions of the patch antennas when the diodes are conducting in order to selectively change the electrical length and resonant frequencies of the patch antennas; and shorting walls connecting each of the PIFA antennas to the sensing element, the sensing element being a ground plane for the PIFA antennas.

2. The cognitive radio antenna assembly according to claim 1, wherein the assembly is a substantially flat assembly measuring about 65×120 $mm^2$, being dimensioned and configured for use in smart phones and LTE mobile handsets.

* * * * *